US007584698B2

(12) United States Patent
Biagioni et al.

(10) Patent No.: US 7,584,698 B2
(45) Date of Patent: Sep. 8, 2009

(54) EMBOSSING ASSEMBLY FOR SHEET MATERIAL

(75) Inventors: Mauro Biagioni, Lucca (IT); Sergio Casella, Fornoli Lucca (IT)

(73) Assignee: Paper Converting Machine Company, Green Bay, WI (US)

( * ) Notice: Subject to any disclaimer, the term of this patent is extended or adjusted under 35 U.S.C. 154(b) by 505 days.

(21) Appl. No.: 11/249,782

(22) Filed: Oct. 13, 2005

(65) Prior Publication Data

US 2006/0086267 A1 Apr. 27, 2006

(30) Foreign Application Priority Data

Oct. 26, 2004 (IT) ..... MI2004A2038

(51) Int. Cl.
*B41F 19/02* (2006.01)
*B41F 5/00* (2006.01)

(52) U.S. Cl. ..... 101/23; 101/6; 101/216; 101/479

(58) Field of Classification Search ..... 101/3.1, 101/4, 5, 6, 22, 23, 216, 218, 247, 479, 480
See application file for complete search history.

(56) References Cited

U.S. PATENT DOCUMENTS

| | | | | |
|---|---|---|---|---|
| 3,039,387 | A * | 6/1962 | Zimmer et al. | 101/216 |
| 4,199,202 | A * | 4/1980 | Maeda | 384/432 |
| 5,022,251 | A * | 6/1991 | Negrussi | 72/239 |
| 5,100,312 | A * | 3/1992 | Wiener | 425/186 |
| 5,669,302 | A * | 9/1997 | Rogge et al. | 101/216 |
| 6,109,326 | A | 8/2000 | Leakey et al. | 156/553 |
| 6,470,945 | B1 | 10/2002 | Biagiotti | 156/553 |

FOREIGN PATENT DOCUMENTS

| | | | |
|---|---|---|---|
| EP | 0 370 972 | A1 | 11/1989 |
| EP | 0 928 682 | A1 | 12/1998 |
| EP | 0 928 682 | A1 | 7/1999 |
| GB | 2 373482 | A | 9/2002 |
| GB | 2 405 613 | | 12/2005 |
| WO | WO 97/20689 | | 6/1997 |
| WO | WO 98/53985 | | 12/1998 |
| WO | WO 2004/002727 | | 1/2004 |
| WO | WO 2005/123374 | A1 | 12/2005 |

* cited by examiner

*Primary Examiner*—Ren Yan
(74) *Attorney, Agent, or Firm*—Greer, Burns & Crain, Ltd.

(57) ABSTRACT

An embossing assembly for sheet material includes at least two embossing rollers, the ends of which are rotatably mounted in the side panels of an embossing machine. Each of the side panels is divided into a fixed portion and at least one movable portion. The ends of the embossing rollers are mounted in supports which are removably fixed in seats formed in the fixed portions of the side panels or in the movable portions of the side panels of the machine. In this manner, when the movable portions of side panels are moved with respect to the fixed portions of side panels, a space is cleared for removal of at least a portion of the embossing roller supports.

19 Claims, 12 Drawing Sheets

EMBOSSING ASSEMBLY FOR SHEET MATERIAL

RELATED APPLICATION

Applicants claim priority of Italian Patent Application No. MI 2004A 002038, filed Oct. 26, 2004.

BACKGROUND

The present invention refers to an embossing assembly for sheet material, in particular paper, such as tissue paper, toilet paper and the like.

Embossing machines provided with embossing rollers or cylinders supported rotatably at their ends, by means of bearings, in the side panels of the embossing machine frame are known on the market. Such embossing rollers are provided with a sleeve, generally of steel, engraved with the embossing patterns, so as to be able to perform embossing of respective plies of paper which are subsequently coupled together by nested or tip-to-tip coupling, so as to obtain a multi-ply embossed web.

Embossing rollers must be accessible and/or removable both for maintenance (for example, replacement of bearings) and due to the need to change the embossing patterns on the web and thus the engraving on the sleeve of the embossing roller. Removal of the embossing rollers leads to considerable machine stoppages, because it is necessary to remove and re-assemble some parts of the embossing machine due to the difficult accessibility to these embossing rollers. Furthermore, the embossing rollers must be set to make the engravings of the two plies coincide. For this purpose it is necessary to perform a relative transverse and angular adjustment of the rollers. This operation proves to be complex, slow and laborious. For these reasons, machine stoppages for replacement of the embossing rollers are of the order eight hours.

Furthermore, depending upon the diameter and engravings of each embossing roller, it is necessary to vary the center distance between the two embossing rollers. In embossing machines of the prior art, the center distance between the embossing rollers is generally fixed since the embossing roller supports are integral with the side panels of the frame in a fixed position, or the housing of the bearing is even formed in the side panels themselves.

There are other embossing machines in which an embossing roller is mounted on a movable side panel which is pivoted to a fixed side panel. In these machines adjustment of the center distance between the embossing rollers is achieved by adjusting the rotation and thus the proximity of the movable side panel to the fixed side panel. This solution makes production of the machine costly and adjustment of the center distance complex.

European patent application EP 0 928 682 discloses an embossing machine in which an embossing roller is supported rotatably at its ends by two movable portions of the side panel, pivoted to the two fixed side panels of the machine frame. In this manner, to carry out replacement of the embossing rollers, the two movable portions of the side panel are rotated so as to move the two embossing rollers apart and leave space for removal thereof.

Even if this system speeds up embossing roller changes compared to embossing machines in which the rollers are mounted in fixed side panels, there still remain therein some drawbacks in that the access space is in any case limited, it is not possible to carry out simultaneous replacement of both rollers, and adjustment of the distance between the rollers is complex.

SUMMARY OF THE INVENTION

The object of the present invention is to overcome the drawbacks of the prior art by providing an embossing assembly for sheet material that is able to simplify and speed up embossing roller replacement and adjustment operations.

Another object of the present invention is to provide such an embossing assembly that is reliable and at the same time suitable to be installed in a compact embossing machine that occupies little space.

These objects are achieved in accordance with the invention with the characteristics listed in the appended independent claims. Additional advantageous embodiments of the invention are described in the dependent claims.

The embossing assembly for sheet material according to the invention comprises at least two embossing rollers, the ends of which are mounted rotatably in the side panels of an embossing machine. Each of the side panels is divided into a portion of a fixed side panel and at least one portion of a movable side panel.

The ends of the embossing rollers are mounted in supports which are fixed removably in seats formed in the fixed side panels or in the movable side panels of the machine. In this manner, when the movable side panel is moved with respect to the fixed side panel, a space is cleared for removal of at least one portion of the support of the embossing rollers.

It is obvious that this system allows easy replacement of the embossing rollers, which can be raised and lowered by means of a hoist, after disengagement from the side panel of the portions of the support or of the support.

The movable portion of side panel advantageously translates with respect to the fixed portion of the side panel, and the supports of the embossing rollers are mounted removably in the fixed side panel. According to an alternative embodiment, the movable portion of side panel is pivoted to the fixed portion of the side panel.

DESCRIPTION OF THE DRAWING

Further characteristics of the invention will be made clearer by the detailed description that follows, referring to a purely exemplary and therefore non-limiting embodiment thereof, illustrated in the appended drawings, in which.

DESCRIPTION OF SPECIFIC EMBODIMENT

An embossing assembly according to a preferred embodiment of the invention is described with the aid of the figures.

Figure 1:
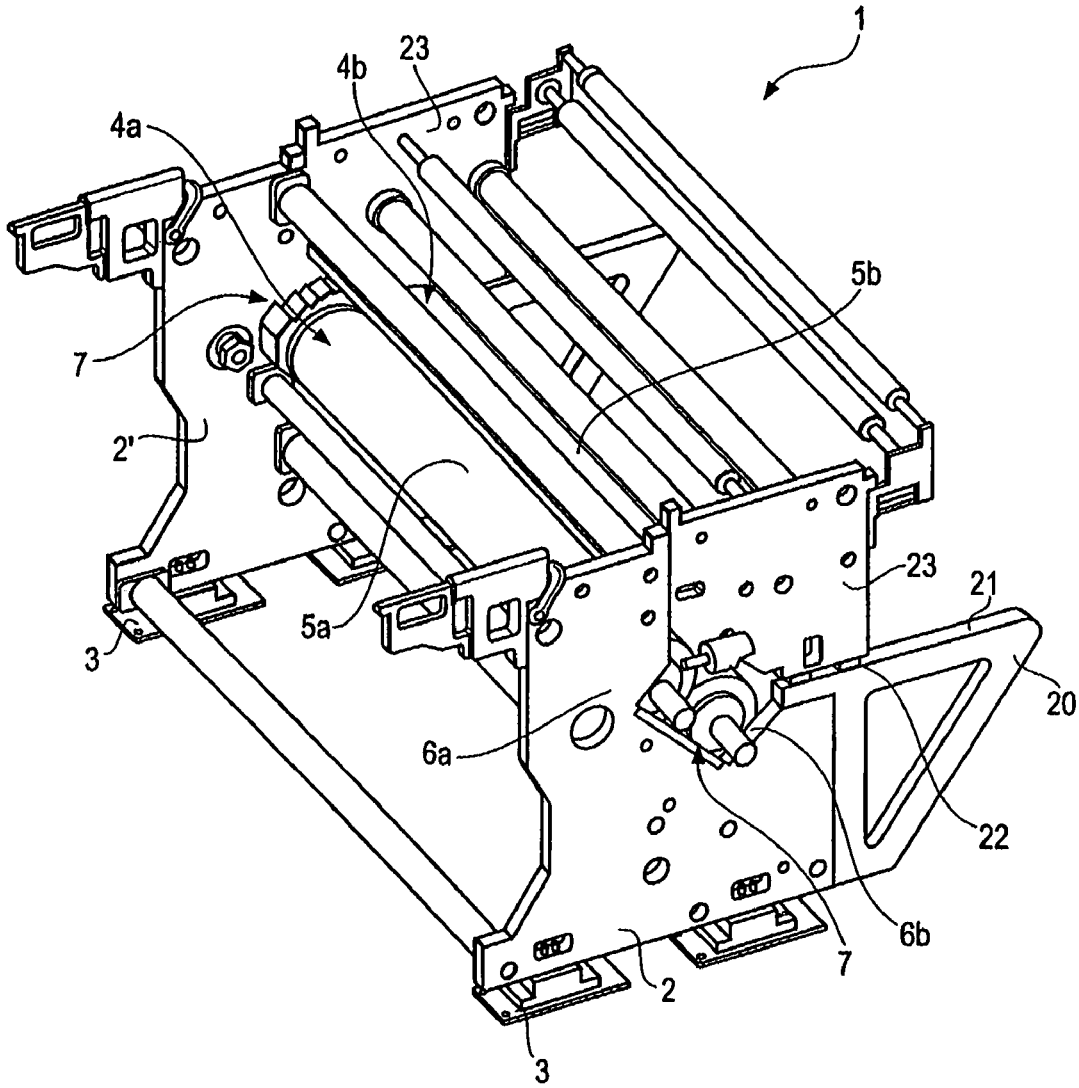
FIG. 1 is a perspective view of an embossing machine according to the invention in which the gluing assembly has been removed.

FIG. 1 shows an embossing machine, denoted as a whole with reference numeral 1. The embossing machine 1 comprises two side panels or shoulders, each of which comprises at least one fixed portion 2, 2' disposed fixedly on a base 3. Two rollers or embossing cylinders 4A, 4B are mounted rotatably in the fixed portions 2, 2' of the side panels. Each embossing roller 4A, 4B comprises a sleeve of engraved steel 5A, 5B and two end portions 6A, 6B with a smaller diameter. The ends 6A, 6B of the embossing rollers are supported rotatably on supports 7 mounted in the fixed portions 2, 2' of the side panels.

Figure 2:
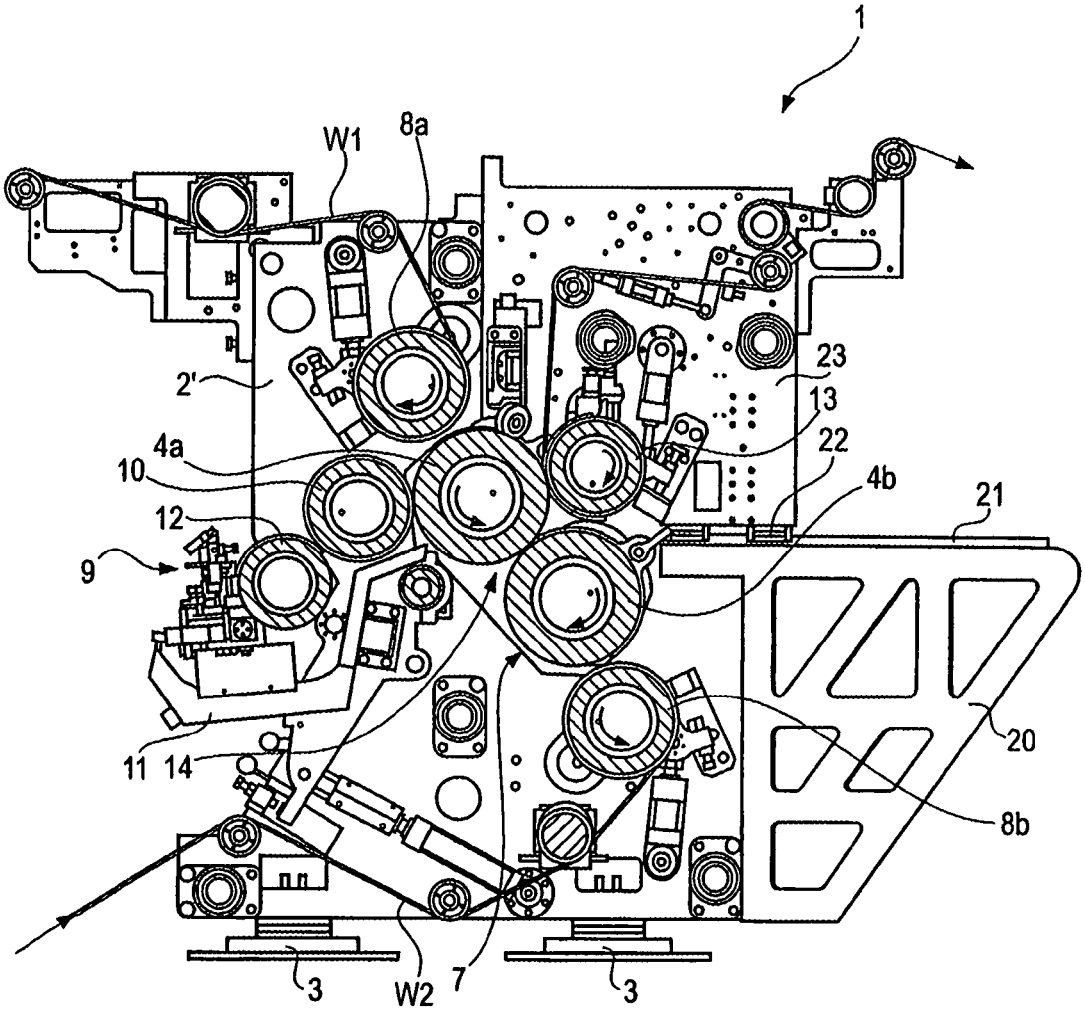
FIG. 2 is a diagrammatic view in cross section of the embossing machine of FIG. 1, taken along a vertical plane between the two side panels of the machine and parallel thereto, in which the gluing assembly has also been schematised.

The operation of the embossing machine 1 is described schematically with reference to FIG. 2. The embossing machine 1 works two plies W1, W2 of material, for example, paper, and carries out embossing of each of the two plies between a pair of rollers coupled together, comprising an engraved steel roller and a rubber-coated counter-pressure roller. The upper ply W1 passes through the top pair of rollers consisting of a first embossing roller 4A and a rubber-coated roller 8A. The two rollers 4A, 8A are brought into contact with a working pressure. The upper ply W1 passes through the two rollers 4A, 8A so as to be marked with the engraving of the steel roller 4A.

On leaving the point of contact between the two rollers 4A, 8A, the upper ply W1 remains in contact with the steel roller 4A for an angle of about 270°. In this manner the upper ply W1 can come into contact with a glue distributing assembly 9 which, by means of a distributing roller 10, deposits a layer of glue on the ply W1. It should be noted that the distributing roller 10 and the upper embossing roller 4A are not in contact, but are adjusted so that the glue comes into contact only with the paper ply W1.

The glue distributing assembly 9 works as follows. The glue is contained in a tank 11. A first roller 12 rotates partially immersed in the tank 11 and distributes the glue which is deposited on the its surface on the glue distributing roller 10. The glue distributing roller 10, thanks to its particular surface finish, collects a uniform amount of glue on its surface and spreads a uniform layer of glue on the paper ply W1.

The bottom ply of paper W2 passes between the bottom pair of rollers consisting of the second embossing roller 4B and a rubber-coated roller 8B so as to be marked by the engraving of the steel roller 4B. The ply W2 remains wound on the steel roller 4B for an angle greater than 90°. The bottom ply W2 then detaches from the steel roller 4B to couple with the upper ply W1. In this coupling the surface of the bottom ply W2 comes into contact with the glued surface of the upper ply W1.

The two embossing rollers 4A and 4B are near to, but not in contact with, each other. A gap 14 just large enough for the two plies W1, W2 to pass without touching each other is left therebetween. Moreover, the embossing rollers 4A and 4B must be placed at a definite center distance to facilitate the timing system of the rollers, that is, to ensure that the engravings of the two plies W1, W2 are superimposed one upon another during coupling, in the case of nested coupling.

Above the bottom embossing roller 4B there is disposed a coupling roller 13, commonly known as a marrying roller, mounted on arms which are pivoted to the side panels of the machine. In this manner, the marrying roller 13 enters into contact with the upper embossing roller 4A and presses the two plies W1, W2 together so as to cause gluing to take place and to obtain a two-ply embossed web W as the output. The two-ply embossed web W is guided out of the embossing machine 1 by means of idler rollers 15 suitably disposed to adjust the pull thereof.

It should be noted that this embossing machine 1 proves to be very compact, and, without the invention, access to the steel rollers 4A and 4B would be problematical because the rollers are obstructed by the gluing assembly 9 and by the upper rubber-coated roller 8A on one side and by the marrying roller and the lower rubber-coated roller 8B on the other side. Furthermore, for the operating reasons described above, the embossing rollers 4A and 4B must be disposed near to each other and at a well-defined center distance to regulate their timing and the width of the gap 14 for passage of the plies W1 and W2.

The embossing assembly according to the invention is described hereunder.

Figure 3:
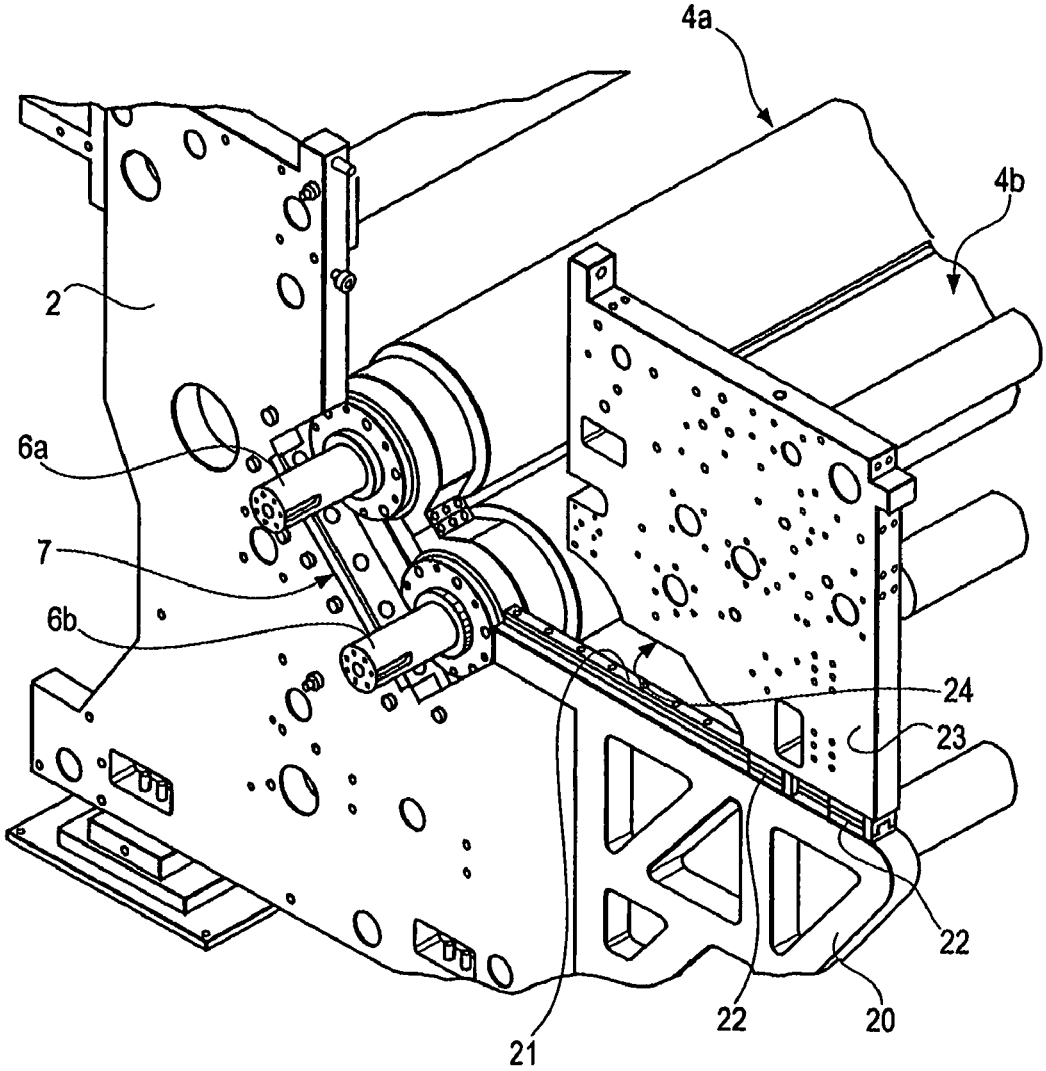
FIG. 3 is a fragmentary perspective view illustrating one of the fixed shoulders of the machine which supports the embossing assembly according to the invention, and a movable shoulder part in the open position for changing the embossing rollers.
Figure 4:
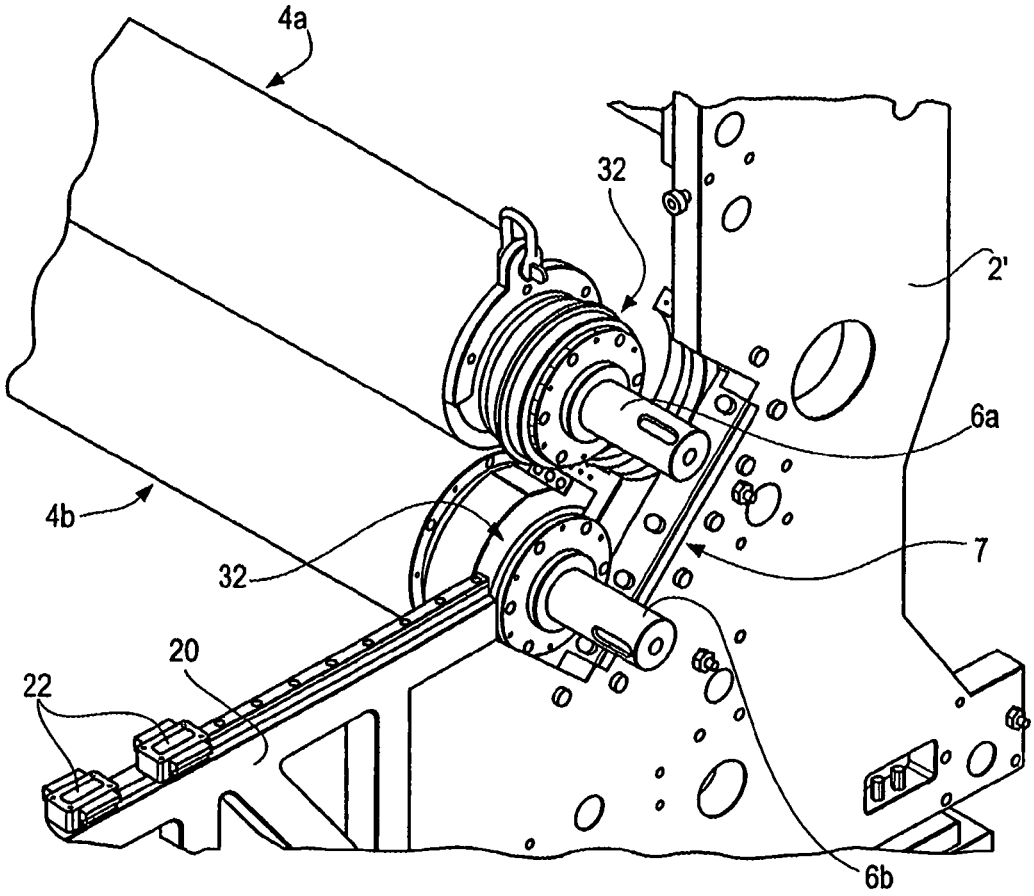
FIG. 4 is a fragmentary perspective view, illustrating the other fixed shoulder of the machine which supports the embossing rollers, showing one of the other rollers about to be removed and the part of movable shoulder omitted for greater clarity.
Figure 5:
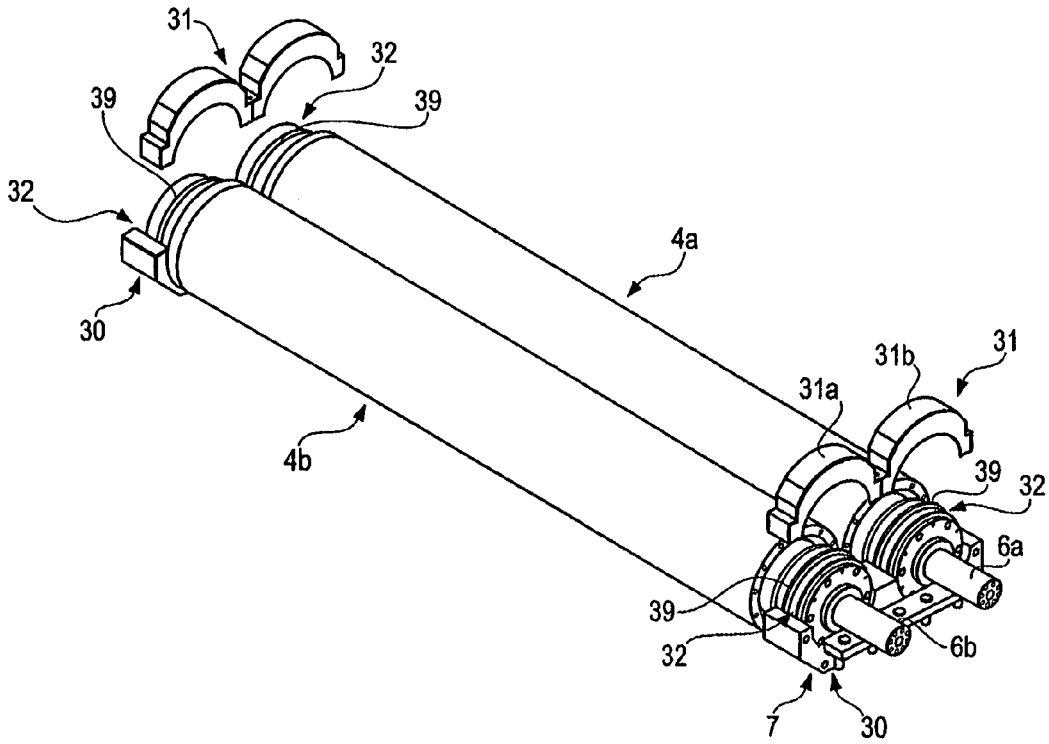
FIG. 5 is a partially exploded perspective view illustrating two embossing rollers supported at their ends by the bottom part of the supports according to the invention, the upper parts of the supports being illustrated in a raised position.

With reference to FIGS. 1, 3 and 4, two oblique, upwardly open seats, designed to receive the supports 7 of the ends 6A, 6B of the embossing rollers, are formed in the fixed portions 2, 2' of the side panels of the machine. Alongside the seat of each support 7 is disposed a bracket 20 integral with the fixed portion of the side panel 2, 2'. A guide rail 21 (FIG. 3) disposed along a horizontal plane is formed on the upper edge of the bracket 20. A movable portion 23 of the side panel is disposed in a vertical plane coinciding with the plane of the fixed portion 2, 2' of the side panel, and is mounted on slides 22 so that the movable portion 23 can slide on the guide rail 21.

The bottom edge of the movable portion 23 of the side panel (FIG. 3) has a profile 24 which repeats the profile of the upper part of the support 7. In this manner, the movable portion 23 of the side panel, translating on the guide rail 21, can move from a closed position (illustrated in FIGS. 1 and 2) in which the profile 24 of the bottom edge of the movable portion of the side panel is situated above the support 7 for the ends of the embossing rollers, to an open position (illustrated in FIG. 3) in which an open space is left above the support 7 for the ends of the embossing cylinders.

As shown in FIG. 2, the marrying roller 13 and the various idler rollers 15 are mounted in the movable portion 23 of the side panel. Thus, translation of the movable portion of the side panel 23 into the open position opens a space above the embossing rollers 4A and 4B to allow easy replacement thereof, for example, by raising and lowering by means of an overhead crane or hoist. Clearly, during operation of the embossing machine 1, the movable portion of side panel 23 must be closed to bring the marrying roller 13 and the idler rollers 15 into the correct working position.

The two movable side panels 23 disposed on the fixed portions 2, 2' of the side panels can be moved manually or in an automated fashion by means of actuators or a motorized system. Clearly, movement of the two movable portions of the side panel is synchronized. Locking systems are provided to lock the movable portions 23 of the side panels in the open and closed positions. The slides 22 of the movable portions 23 of the side panels are connected to the guide rails 21 of the bracket 20 by means of precise locators (for example, pins), so as to ensure that the relative positions of the marrying roller 13 with respect to the first embossing roller 4A are respected.

In the above description and in the figures a single movable portion of the side panel has been illustrated on each fixed portion of the side panel. However, each side panel can be provided with a plurality of movable portions of the side panel slidable on the fixed portions of the side panel or a plurality of movable portions mutually slidable with respect to each other.

Figure 6:
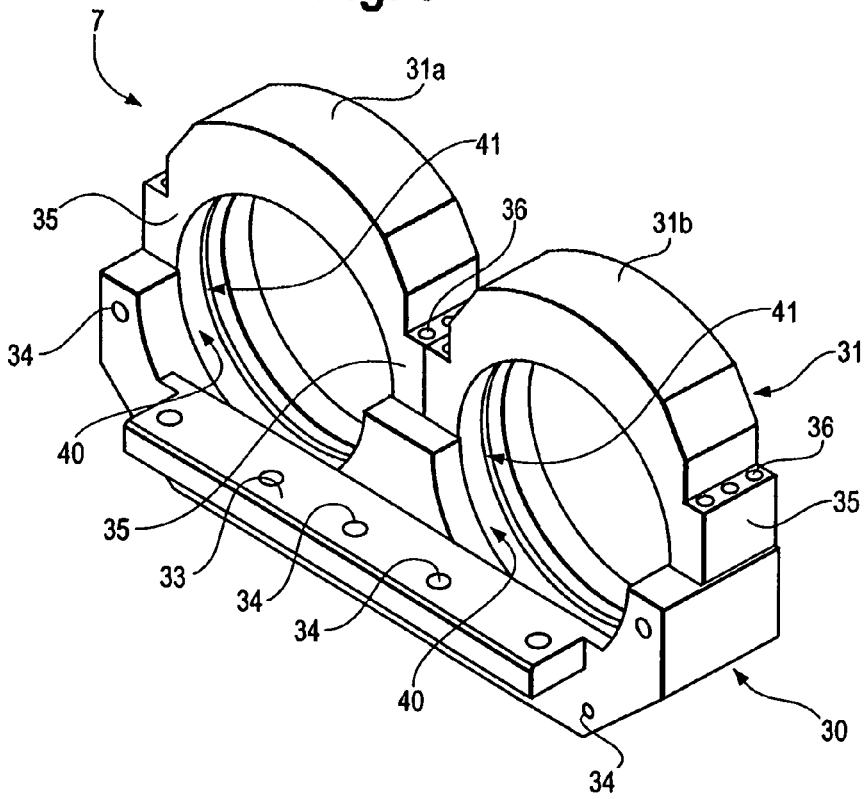
FIG. 6 is a perspective view of the assembled supports for the ends of the embossing rollers.
Figure 7:
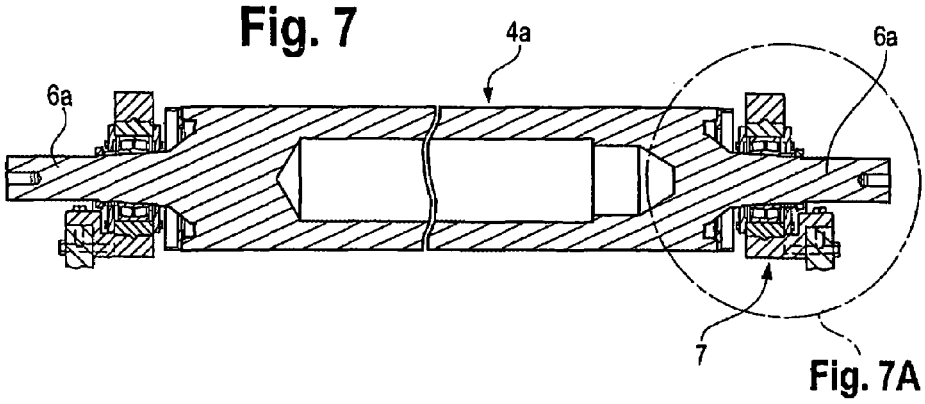
FIG. 7 is a fragmentary longitudinal sectional view of an embossing roller supported at its ends by fixed supports on the fixed side panels of the machine.
Figure 7A:
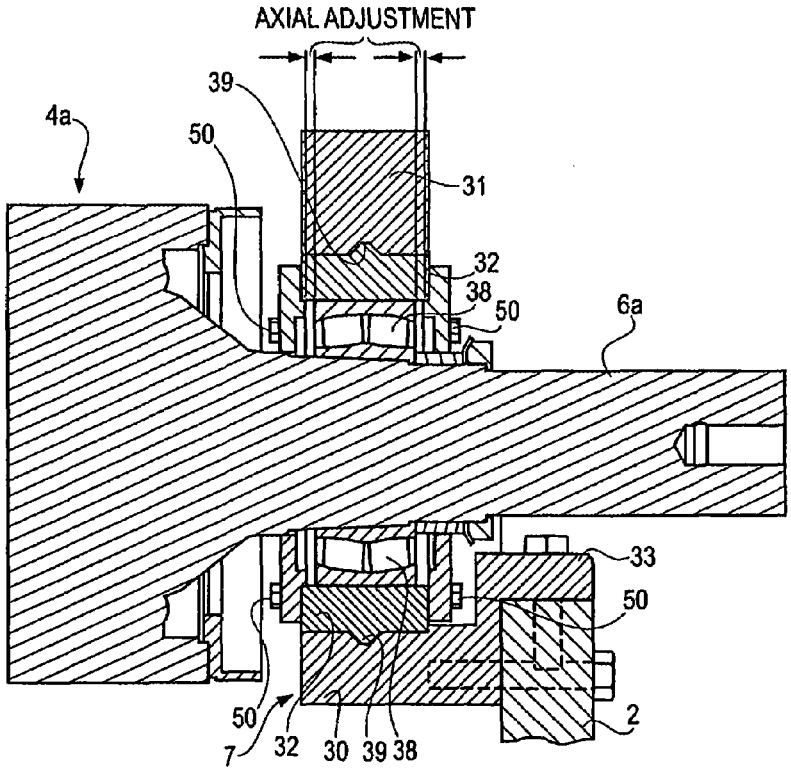
FIG. 7A is an enlarged view of the detail enclosed in the circle A of FIG. 7.

The support 7 for the ends of the embossing rollers is described in detail with reference to FIGS. 5, 6, 7 and 7A. As shown in FIG. 6, the support 7 is shaped substantially as an overturned "8", so as to define two annular seats 40 within which bushes 32 (FIG. 5) mounted at the ends 6A, 6B of the embossing cylinders 4A, 4B are housed. As shown in FIG. 7A, roller or ball bearings 38 are housed inside the bushes 32.

With reference mainly to FIG. 6, the support 7 comprises a bottom portion 30 and a top portion 31 that can be assembled with each other. Each of the bottom and top portions 30, 31 of the support 7 is shaped as an overturned "3", so as to define a concave arched seat with an arc of 180°. The top support 31 can be in a single piece or divided into two separate parts 31A and 31B, each consisting of a substantially C-shaped arc of 180°.

The bottom part 30 of the support has a flat protruding bar 33 provided with holes 34 to receive bolts for fixing to the fixed portion 2, 2' of the side panel of the machine along the oblique edge of the seat designed to receive the support 7. Through holes 34 are also provided in the bottom part 30 of the support to receive bolts for fixing to the fixed portion of the side panel.

The top part 31 of the support has feet 35 in which through holes 36 are formed to receive bolts for fixing to the bottom part 30 of the support.

Annular grooves 41 are formed in the annular seats 40 of the support 7 for receiving an annular protrusion 39 formed in the bearing bushes 32 for correct centering of the bushes 32 in the seats 40 of the support. Furthermore, as shown in FIG. 7A, thrust pins 50, disposed with their axes parallel to the axis of the embossing cylinder 4A, are provided in the bushes 32 to allow axial adjustment of the bushes 32.

The use of this support 7 for the bearing bushes 32 which can be mounted integrally with the fixed portion 2, 2' of the side panel, but is distinct and removable thereform, allows various advantages. In fact, it is also possible to disconnect the entire support 7 from the fixed portion 2, 2' of the side panel and to remove the embossing rollers 4A, 4B together with the support 7. In this manner the embossing rollers can be replaced with another pair of rollers already assembled with another support.

By changing the size of the support 7 and in particular the center distance between the two housings 40 for the bushes 32 at the ends of the embossing rollers, it is possible to achieve complete flexibility in the choice of the embossing rollers (diameter and working distance between the sleeves of the two embossing rollers). In fact, the two embossing rollers 4A, 4B must work at a distance from each other that is well defined but variable according to the engraving present in the roller sleeve.

Furthermore, by varying the diameter of the rollers, their peripheral speed is adapted to the ideal embossing speed (in relation to the engraving or the product being processed), without changing the transmission system when the pair of embossing rollers is changed.

The support system 7 together with the bearing bush 32 mounted on the end of the embossing roller allows easy mounting of the roller to be performed. In the first assembly, the grooved guide 41 formed in the seat 40 of the support 7 facilitates centering of the bush 32 during housing, in that the protrusion 39 of the bush engages in the grooved guide 41. Furthermore, by means of the thrust pins 50 for axial adjustment, it is possible to adjust the position of the bush 32 and cause the embossing roller to translate axially to perform transverse timing of the rollers, and to lock the bearing 38 inside the bush 32.

Once the previous adjustment has been performed, in subsequent operations of replacement and assembly of the embossing roller, transverse timing will be maintained and it will only be necessary to fix the top part 31 of the support after having lowered the roller with an overhead crane so that the bushes 32 of the roller engage in the seats 40 of the bottom part 30 of the support.

Although in the figures the support 7 has been illustrated mounted in the fixed portion of side panel and a movable portion 23 of the side panel translating with respect to the fixed portion 2, 2' of the side panel has been provided, it will be understood that the support 7 according to the invention can also be mounted removably either in a movable portion of the side panel or in a fixed portion of the side panel of the machine, irrespective of whether the movable portion of the side panel of the machine translates or rotates with respect to the fixed portion of the side panel.

In fact, in any case, movement of the movable portion of the side panel with respect to the fixed portion of the side panel will create the space necessary for removal of the entire support 7 or of portions 31, 31A, 31B of the support to perform replacement of the rollers. Thus, provision of the removable support considerably facilitates the operation of replacement of the embossing rollers compared to the prior art.

Furthermore, even though in the figures the support 7 has been illustrated with a single bottom portion 31 provided with two seats 40 to receive the two ends of two embossing rollers, the support 7 can clearly be divided into two separate supports, each to receive the end of a mandrel. In this case each support will have a bottom part with a single seat 40 to receive the end of the mandrel.

The method of replacement of the embossing assembly according to the invention is described with the aid of FIGS. 8-14.

Figure 8:
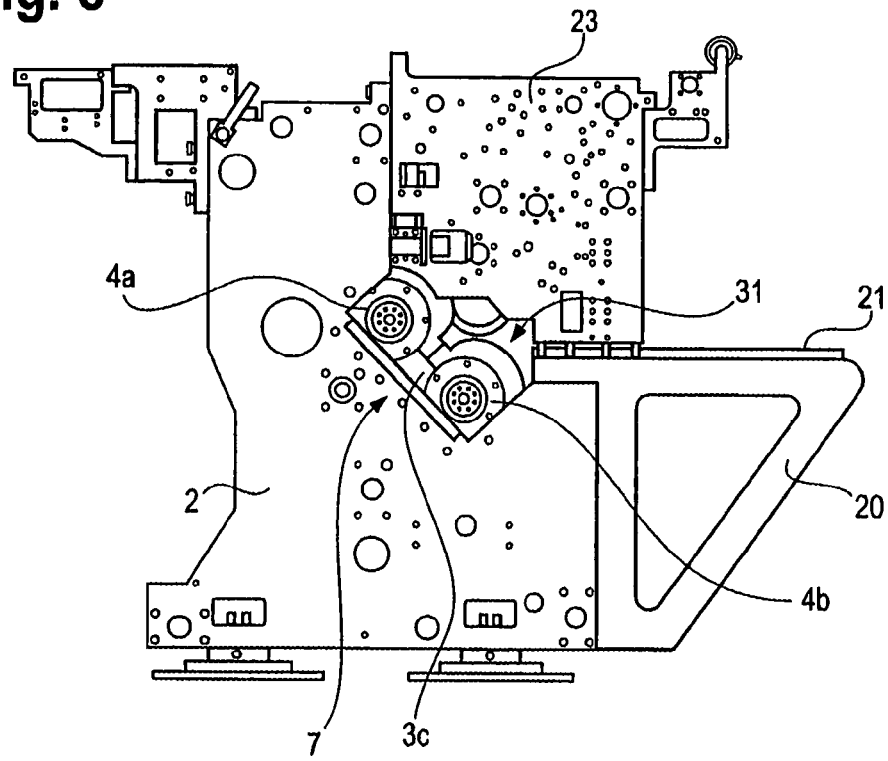
FIGS. 8 through 13 are six diagrammatic side elevational views illustrating the various stages for removal of the embossing cylinders.

FIG. 8 illustrates an embossing machine 1 in operation, in which the bushes on the ends of the embossing rollers 4A, 4B are engaged in the supports 7 which are closed (i.e., the bottom part 30 and the top part 31 of the supports 7 are assembled together). The supports 7 are fixed to the fixed portions 2, 2' of the side panels of the machine. The movable portions 23 of the side panels are in the closed position with their bottom edges above the top parts 31 of the supports 7.

Figure 9:
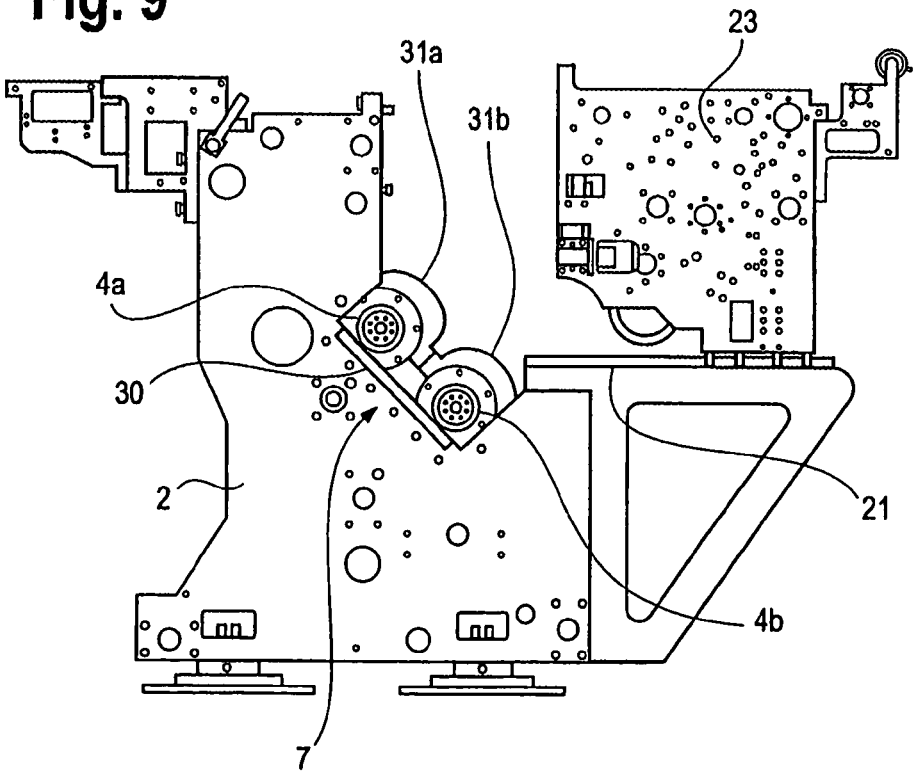

When embossing rollers must be replaced, the motor system of the machine is stopped and, as shown in FIG. 9, the movable portions 23 of the side panels are translated on the guides 21 of the fixed portions 2, 2' of the side panels to bring them into the open position, so as to leave an empty space above the embossing rollers 4A, 4B and the supports 7.

Figure 10:
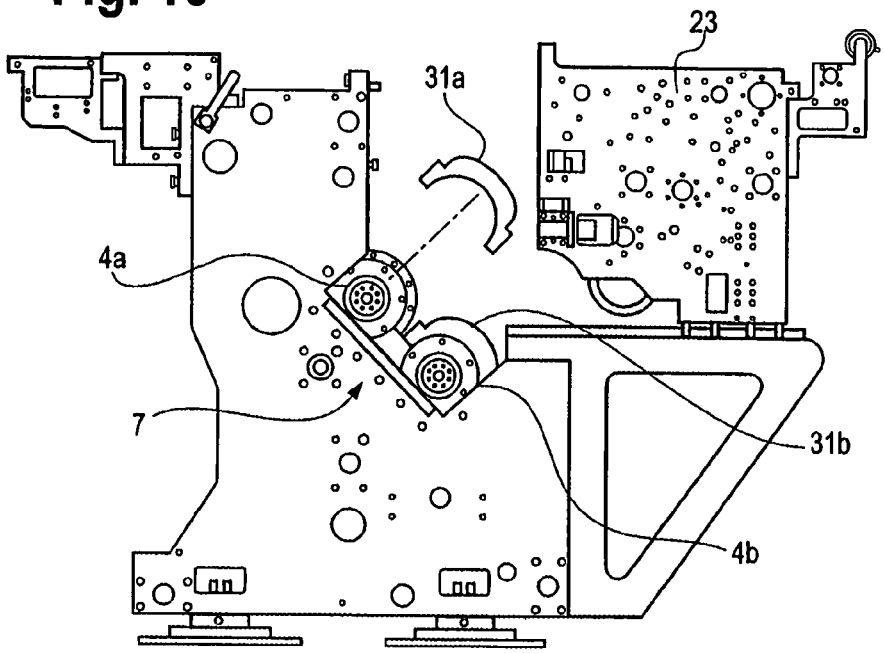

At this point, as shown in FIG. 10, the bolts that fixed the top part 31A of the support 7 are unscrewed and the top part 31A of each support 7 is removed.

Figure 11:
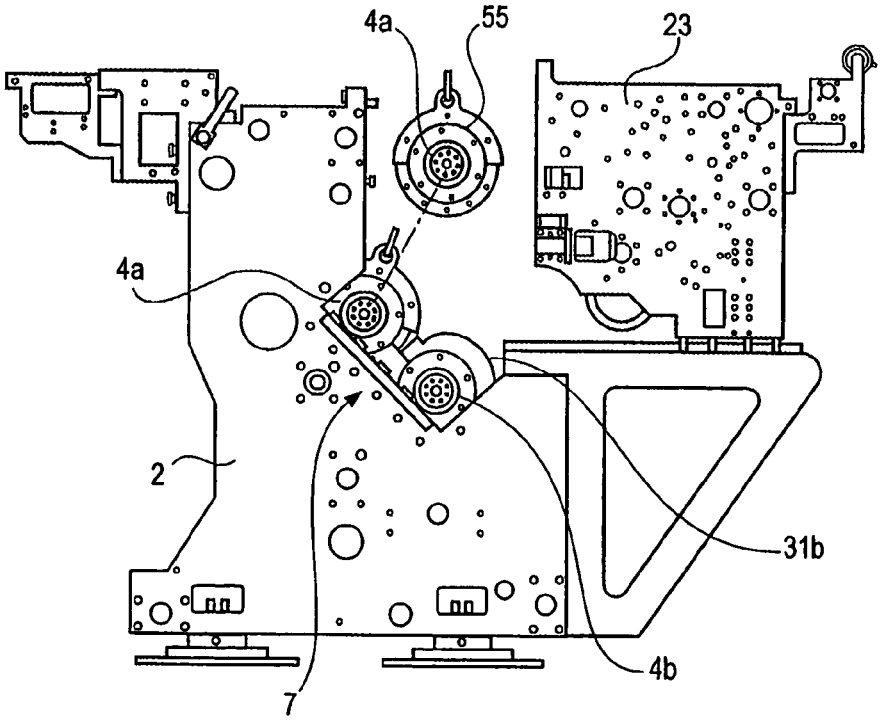

Subsequently, as shown in FIG. 11, the first embossing roller 4A is gripped with a hoist or overhead crane equipped with a suitable gripper 55 and raised so as to remove the bushes 32 on the ends of the embossing roller from the housings 40 of the bottom parts 30 of the respective supports.

Figure 12:
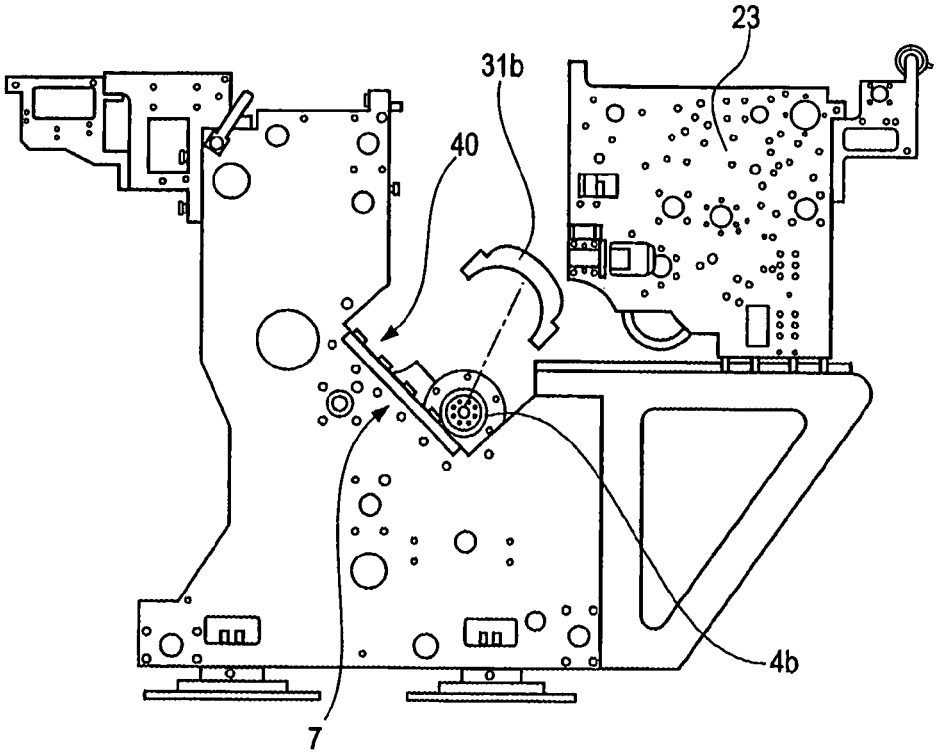
Figure 13:
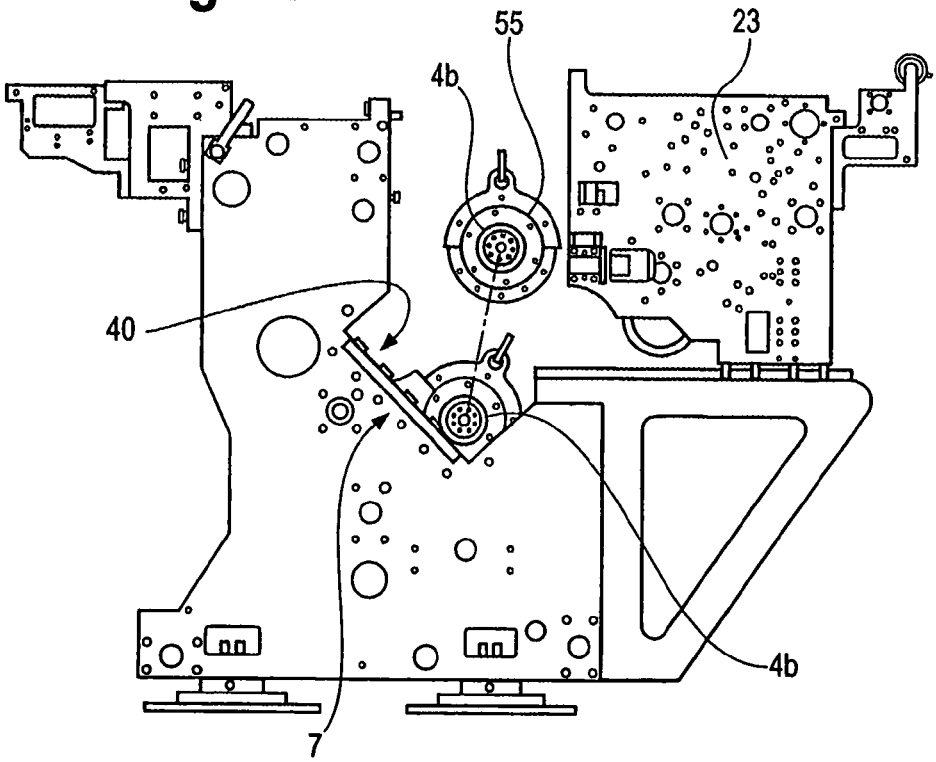

After having removed the first embossing roller, the second top portion 31B of each support 7 is removed as shown in FIG. 12, and the second embossing roller 4B is also removed by means of a hoist as shown FIG. 13.

Figure 14:
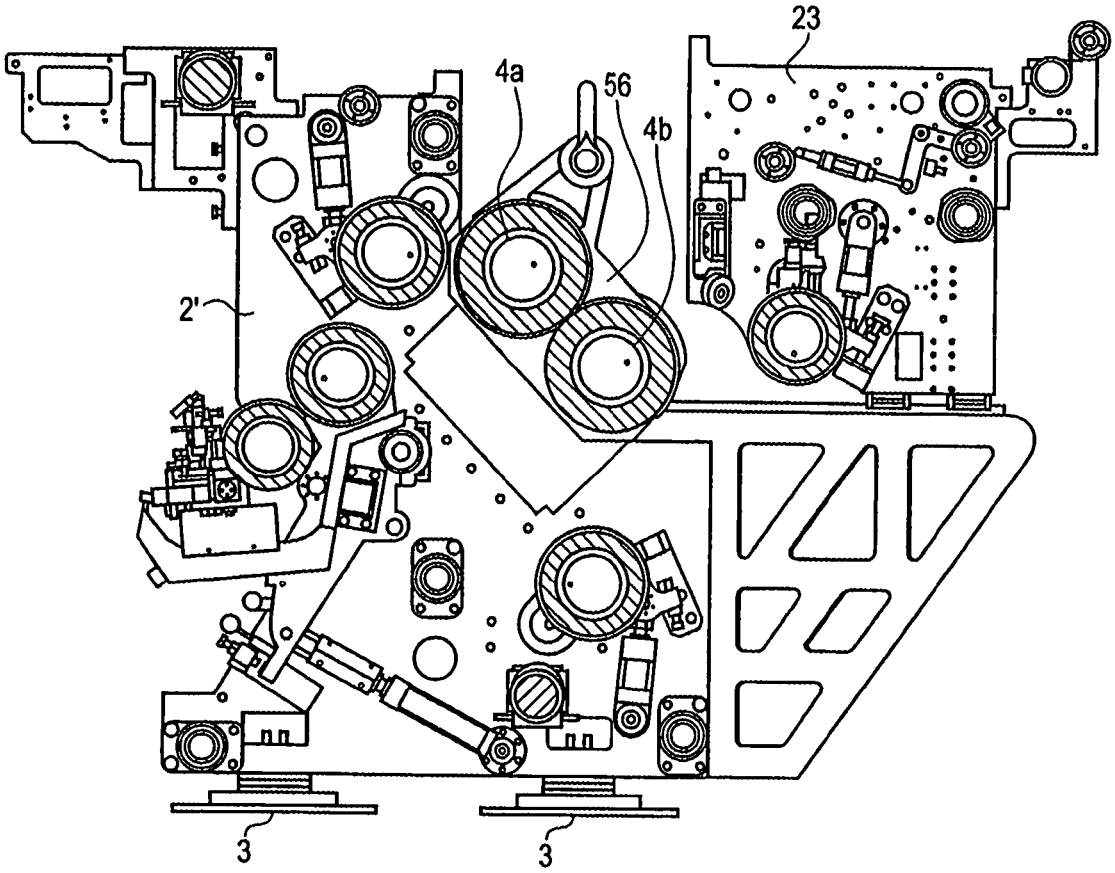
FIG. 14 is a side elevational view showing a device for simultaneous removal of both embossing cylinders.

As shown in FIG. 14, the hoist for lifting the embossing rollers can have a particular gripper means 56 able to simultaneously lift both rollers 4A, 4B.

At this point the two housings 40 of each bottom support 30 are free to receive the new embossing rollers. Clearly, in an inverse manner with respect to the previous description, the supports 7 are closed, fixing the top parts 31A, 31B on the bushes of the new embossing rollers, and the movable portions 23 of the side panels are closed to start a new machine cycle.

If it is desired to change the center distance between the embossing rollers 4A, 4B, the two supports 7 are removed from the side panels together with the embossing rollers 4A, 4B, disengaging the bottom support 30 from each fixed portion 2, 2' of the side panels. A new support 7 is then mounted on each fixed portion of the side panels with a different center distance between the seats from the previous one.

Figure 15:
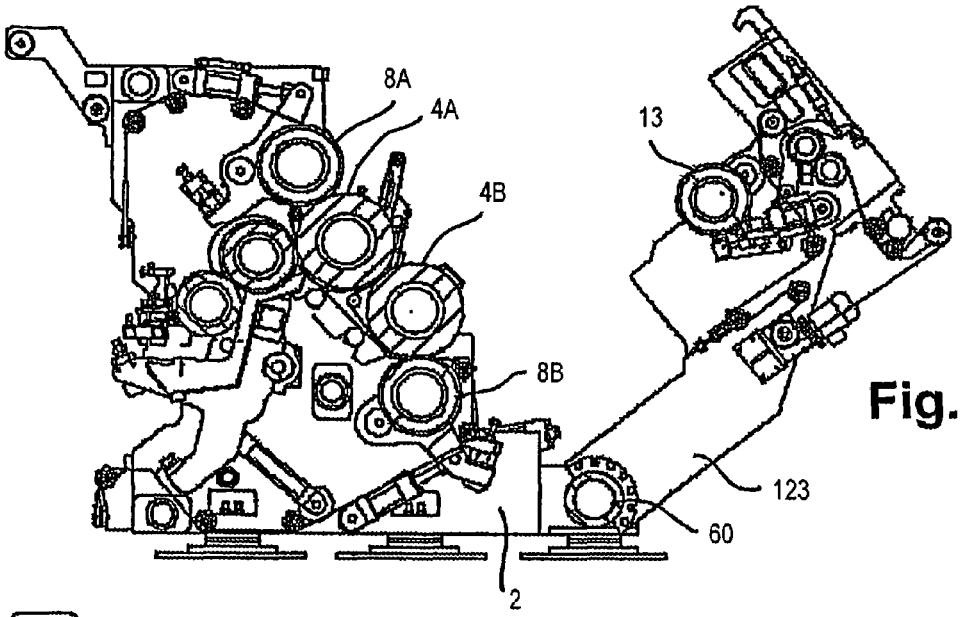
FIG. 15 illustrates another embodiment of the invention in which a portion of the side panel is rotatably or tiltingly mounted with respect to a fixed portion of the side panel.
Figure 16:
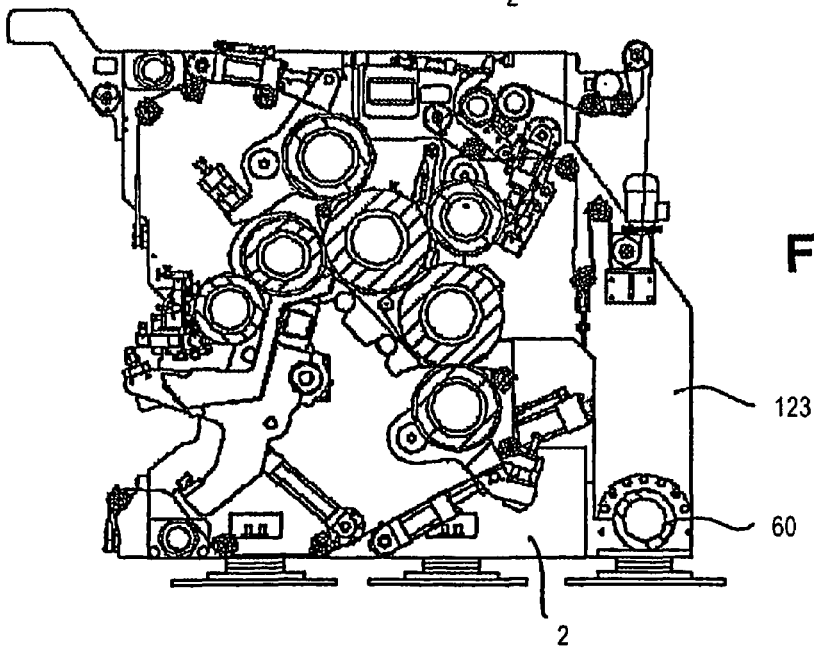
FIG. 16, illustrates the rotatable portion of the side panel of FIG. 15 in a closed position.

FIGS. 15 and 16 illustrate a modified embodiment which is similar to the previous embodiment except that movable portions 123 of the side panels are rotatably or tiltingly mounted with respect to the fixed portions 2, 2' of the side panel. The movable portions are mounted for a rotation on a journal or axle 60 which is mounted on the fixed portions 2, 2' of the side panels.

FIG. 15 illustrates the movable portions of the side panels in an open position. FIG. 16 illustrates the movable portions of the side panels in a closed position.

Figure 17:
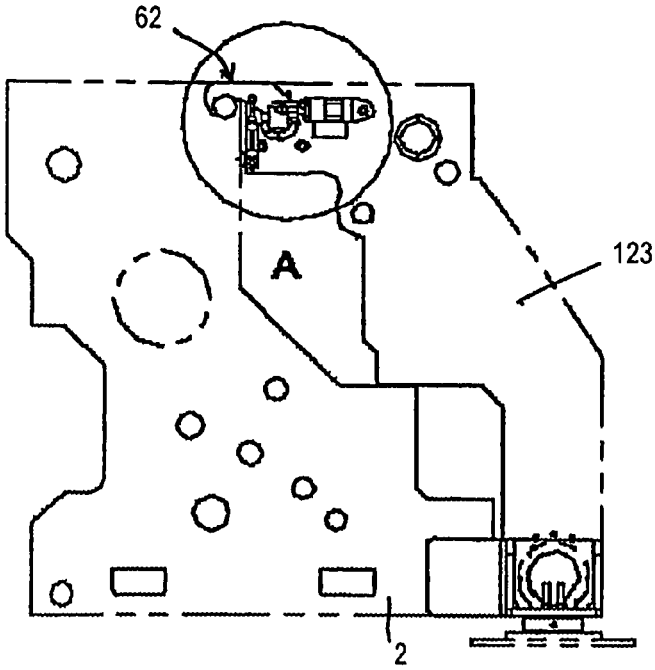
FIG. 17 illustrates a locking device for the movable portion of the side panel.
Figure 18:
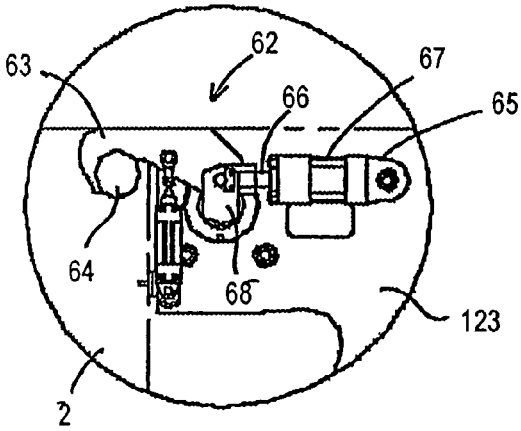
FIGS. 18 and 19 are enlarged fragmentary views of the locking device of FIG. 17.
Figure 19:
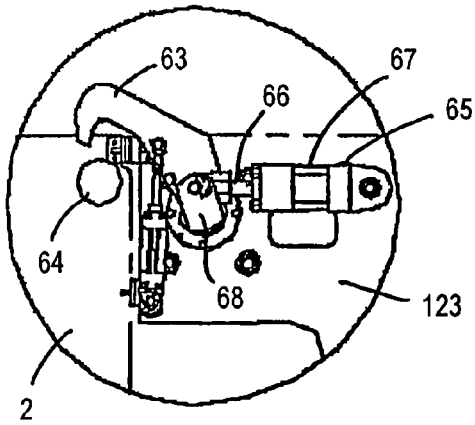

FIGS. 17-19 illustrate a locking device 62 which can be used to lock the movable portions of the side panels. The locking device can be used with any type of movable side panels.

Referring to FIGS. 18 and 19, the locking device includes a latch 63 which is rotatably mounted on each of the movable portions 23 or 123 of the side panels and which is engagable with a pin 64 on the fixed portions 2, 2' of the side panels. The latch 63 is movable between latched (FIG. 18) and unlatched (FIG. 19) positions by an actuator 65. In the embodiment illustrated the actuator is a piston 66 and a cylinder 67. Extension of the piston rotates a lever 68 counterclockwise which rotates the latch clockwise.

Numerous changes and modifications of detail which are within the reach of a person skilled in the art can be made to the present embodiment of the invention without thereby departing from the scope of the invention as set forth in the appended claims.

We claim:

1. An embossing machine for sheet material, comprising:

a pair of side panels, each of the side panels having a fixed portion and a movable portion, the fixed portion of each of the side panels having an oblique, upwardly open seat, a support removably mounted on the oblique, upwardly open seat of the fixed portion of each of said side panels, and a pair of embossing rollers, each of the embossing rollers having a pair of ends which are mounted in the supports on the side panels, the movable portion of each of the side panels being movable between a closed position in which a portion of the movable portion is vertically aligned with a portion of the upwardly open seat on the fixed portion of the side panel and an open position in which the movable portion is moved away from vertical alignment with the upwardly open seat, whereby moving the movable portions of the side panels with respect to the fixed portions of the side panels provides an upwardly open space above the upwardly open seats for upward removal of at least a portion of said supports.

2. The structure of claim 1 including a bearing bush mounted on each end of at least one of said embossing rollers, each of said supports having an annular seat for receiving one of the bearing bushes.

3. The structure of claim 2 in which each of said bearing bushes includes an annular protrusion ands each of said annular seats has a guide groove which receives one of the annular protrusions.

4. The structure of claim 1 including a bearing bush mounted on each end of each of said embossing rollers, each of said supports having a pair of annular seats for receiving a pair of the bearing bushes.

5. The structure of claim 4 in which each of said supports comprises a bottom part attached to one of said side panels and a top part attached to the bottom part so as to define said annular seats.

6. The structure of claim 5 in which each of said bottom parts includes a bar protruding therefrom and bolts attaching each of the bars to one of said side panels.

7. The structure of claim 4 in which each of said bearing bushes includes an annular protrusion and each of said annular seats has a guide groove which receives one of the annular protrusions.

8. The structure of claim 1 in which said supports are removably mounted on said fixed portions of said side panels, each of said movable portions of said side panels being mounted for translation on one of the fixed portions and being movable between a closed position in which it is positioned above one of said supports and an open position in which a space is provided above said embossing rollers to allow replacement thereof.

9. The structure of claim 8 including a linear guide rail mounted on each of said fixed portions of said side panels, each of said movable portions of said side panels being slidably mounted on one of the guide rails.

10. The structure of claim 9 including slides mounted between each of said guide rails and the associated movable portion of the side panel.

11. The structure of claim 10 including locator means for precisely locating said slides on said guide rails.

12. The structure of claim 8 including means for locking said movable portions of the side panels in the closed position during operation of the machine and in the open position during replacement of the embossing rollers.

13. The structure of claim 1 in which said movable portions of said side panels are mounted tiltingly with respect to said fixed portions of said side panels.

14. The structure of claim 1 including a marrying roller and an idler roller rotatably mounted on said movable portions of said side panels.

15. A method of replacing embossing rollers of an embossing machine comprising the steps of:

providing a pair of side panels, each of the side panels having a fixed portion and a movable portion, the fixed portion of each of the side panels having an oblique, upwardly open seat, rotatably mounting a pair of embossing rollers on the oblique, upwardly open seats of said side panels, moving the movable portions of the side panels with respect to the fixed portions of the side panels from a closed position in which a portion of each of the movable portions is vertically aligned with at least one of the embossing rollers to an open position in which each of the movable portions is moved away from vertical alignment with the embossing rollers so as to leave an upwardly open space above the embossing rollers for upward removal of said embossing rollers, and lifting the embossing rollers upwardly from the upwardly open seats to remove the embossing rollers from the embossing machine.

16. The method of claim 15 including the steps of mounting a support for the embossing rollers on each of said panels, and removing at least a portion of each of the supports after moving the movable portions of the side panels.

17. The method of claim 16 in which said supports are mounted in the fixed portions of the side panels.

18. The method of claim 17 including the step of rotatably mounting a marrying roll on the movable portions of the side panels.

19. The method of claim 15 including the steps of mounting a bottom part of a support on each of said side panels, rotatably mounting the embossing rollers on the bottom parts of the supports, and attaching a top part to each of the bottom parts, and, after moving the movable portions of the side panels, removing the top parts.

* * * * *